US012234708B2

(12) United States Patent
Looni et al.

(10) Patent No.: US 12,234,708 B2
(45) Date of Patent: Feb. 25, 2025

(54) CLOSING INFLOW CONTROL DEVICE USING DISSOLVABLE BALLS AND PLUGS

(71) Applicant: Saudi Arabian Oil Company, Dhahran (SA)

(72) Inventors: Qadir Looni, Dhahran (SA); Ahmed Abdullah Al-Mousa, Baluchistan (PK)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/162,862

(22) Filed: Feb. 1, 2023

(65) Prior Publication Data

US 2024/0254865 A1 Aug. 1, 2024

(51) Int. Cl.

| | |
|---|---|
| ***E21B 43/12*** | (2006.01) |
| ***E21B 34/06*** | (2006.01) |
| ***E21B 34/14*** | (2006.01) |
| ***E21B 43/14*** | (2006.01) |

(52) U.S. Cl.

CPC ..... *E21B 43/12* (2013.01); *E21B 43/14* (2013.01); *E21B 34/063* (2013.01); *E21B 34/142* (2020.05)

(58) Field of Classification Search

CPC ..... E21B 43/12; E21B 43/14; E21B 34/063; E21B 34/142; E21B 23/04; E21B 34/14

See application file for complete search history.

(56) References Cited

U.S. PATENT DOCUMENTS

| | | | | |
|---|---|---|---|---|
| 6,886,634 | B2 | 5/2005 | Richards | |
| 8,602,110 | B2 * | 12/2013 | Kuo | E21B 43/12 166/205 |
| 9,562,415 | B2 | 2/2017 | Frazier | |
| 11,041,360 | B2 * | 6/2021 | Penno | E21B 34/08 |
| 11,788,377 | B2 * | 10/2023 | Al Sulaiman | E21B 34/063 166/386 |
| 2020/0182013 | A1 | 6/2020 | Marcin et al. | |

* cited by examiner

*Primary Examiner* — Catherine Loikith
(74) *Attorney, Agent, or Firm* — Fish & Richardson P.C.

(57) ABSTRACT

An assembly for closing inflow control devices (ICDs) using dissolvable balls and plugs includes ICDs, each of which can be installed at a respective fluid producing zone of a subterranean zone to control flow of well fluids from the respective fluid producing zone into a wellbore. The assembly includes compartments corresponding to the ICDs, each to be installed within a respective compartment. The compartments are serially connected to each other and arranged sequentially from an uphole location to a downhole location. The compartments define successively smaller diameters from the uphole location to the downhole location. The assembly includes plugs corresponding to compartments. Each plug can be received in a respective compartment to close flow of well fluids from the subterranean zone into the wellbore through a respective ICD installed in the respective compartment. The plugs are serially connected to each other and installed uphole of the compartments.

13 Claims, 6 Drawing Sheets

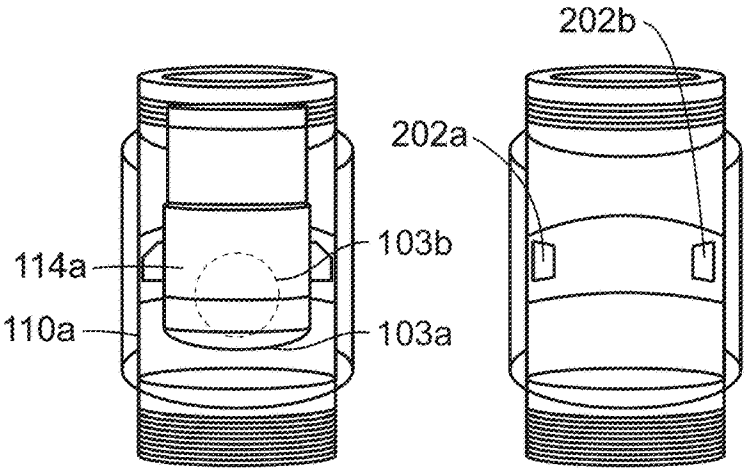
FIG. 2A
FIG. 2B
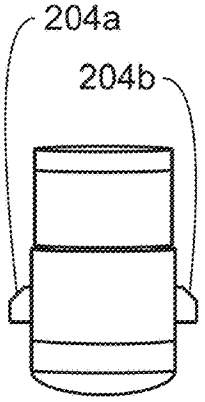
FIG. 2C
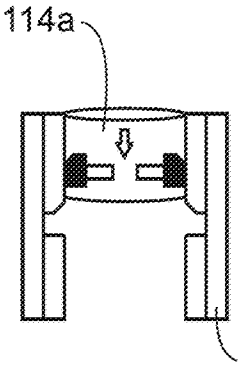
FIG. 2D
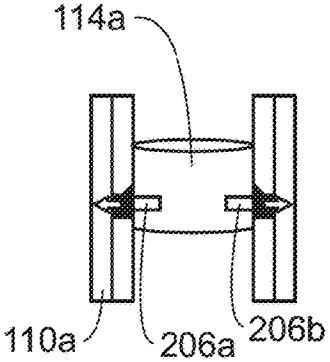
FIG. 2E

CLOSING INFLOW CONTROL DEVICE USING DISSOLVABLE BALLS AND PLUGS

TECHNICAL FIELD

This disclosure relates to wellbore operations and specifically to well completions to control flow of well fluids through wellbores.

BACKGROUND

Hydrocarbons entrapped in subsurface reservoirs can be raised to the surface, i.e., produced, through wellbores formed from the surface through a subterranean zone (e.g., a formation, a portion of a formation, multiple formations). A subterranean zone can have multiple production zones, i.e., layers of rock, in which the hydrocarbons (e.g., oil, gas, combinations of them) are entrapped. Certain zones can include water while others can include no fluids and instead can be cap rock that separates two zones. Being able to control the flow of hydrocarbons (or well fluids) from each zone into a wellbore gives a well operator more control of hydrocarbon production through the wellbore. An inflow control device (ICD) is a well completion tool that is used to control flow of fluids from zones, including production zones, into the wellbore.

SUMMARY

This disclosure describes technologies relating to closing ICDs using dissolvable balls and plugs.

Certain aspects of the subject matter described here can be implemented as a well completion assembly. The assembly includes multiple ICDs, each of which can be installed at a respective fluid producing zone of a subterranean zone and can control flow of well fluids from the respective fluid producing zone into a wellbore formed in the subterranean zone. The assembly includes multiple compartments corresponding to the multiple ICDs. Each ICD is configured to be installed within a respective compartment. The multiple compartments are serially connected to each other and arranged sequentially from an uphole location to a downhole location. The multiple compartments define successively smaller diameters from the uphole location to the downhole location. The assembly includes multiple plugs corresponding to multiple compartments. Each plug can be received in a respective compartment to close flow of well fluids from the subterranean zone into the wellbore through a respective ICD installed in the respective compartment. The multiple plugs are serially connected to each other and installed uphole of the multiple compartments.

An aspect combinable with any of the other aspects includes the following features. Each compartment defines a profile formed as a slot in an inner wall of each compartment. Each plug includes an extendable member configured to fit in the slot of the respective compartment in which each plug is configured to be received.

An aspect combinable with any of the other aspects includes the following features. Each plug includes a spring connected to the extendable member. With the spring in a biased state, the extendable member is retracted within the plug. In response to the extendable member being radially aligned with the profile, the spring returns to an unbiased state to radially push the extendable member into the slot.

An aspect combinable with any of the other aspects includes the following features. The multiple plugs are directly connected to each other and suspended uphole of the multiple compartments.

An aspect combinable with any of the other aspects includes the following features. Each plug defines a ball seat configured to receive a ball. Each plug, upon receiving the ball in the ball seat and in response to pressure, is configured to detach from remaining plugs and to travel in a downhole direction towards the multiple compartments.

An aspect combinable with any of the other aspects includes the following features. The assembly includes a wellbore tubing in which the multiple compartments are mounted.

An aspect combinable with any of the other aspects includes the following features. The multiple compartments are spaced apart along a length of the wellbore tubing.

An aspect combinable with any of the other aspects includes the following features. A packer is configured to be installed uphole of the multiple plugs.

An aspect combinable with any of the other aspects includes the following features. The assembly includes a tubing fluidically coupled to the multiple plugs, passing through the packer, and extending to a surface of the wellbore. The tubing is configured to flow well fluids produced through the multiple ICDs towards the surface.

An aspect combinable with any of the other aspects includes the following features. The multiple ICDs and the multiple compartments form a downhole completion assembly. The assembly includes an uphole completion assembly configured to be installed within the wellbore uphole of the packer.

An aspect combinable with any of the other aspects includes the following features. The uphole completion assembly includes an electrical submersible pump (ESP) fluidically coupled to the tubing. The ESP can raise the well fluids towards the surface. The uphole completion assembly includes a gas separator fluidically coupled to the ESP and the tubing. The gas separator can separate gaseous phase from the well fluids before the well fluids are flowed through the ESP. The uphole completion assembly includes a subsurface safety valve (SSSV) fluidically coupled to the tubing and installed uphole of the ESP and the gas separator.

Certain aspects of the subject matter described here can be implemented as a method. Multiple compartments, serially connected to each other, are installed in a wellbore formed through a subterranean zone including multiple fluid producing zones. The multiple compartments are arranged sequentially from an uphole location to a downhole location. Each compartment is installed in a respective fluid producing zone. The multiple compartments define successively smaller diameters from the uphole location to the downhole location. In the multiple compartments, a respective multiple ICDs are installed. Each ICD is configured to control flow of well fluids from the respective fluid producing zone into the wellbore. Multiple plugs, corresponding to the multiple compartments, are installed in the wellbore and uphole relative to the multiple ICDs. Each plug is configured to be received in a respective compartment to close flow of well fluids from the subterranean zone into the wellbore through a respective ICD installed in the respective compartment. The multiple plugs are serially connected to each other and installed uphole of the multiple compartments. In response to identifying a fluid producing zone from which well fluid into the wellbore is to be cased, a corresponding plug of the multiple plugs is released. The released plug is received by the respective compartment and closes the respective ICD installed within the respective compartment.

An aspect combinable with any of the other aspects includes the following features. To release the corresponding plug, a ball configured to dissolve in a presence of a well fluid, is dropped from a surface onto a ball seat included in the released plug. After dropping the ball onto the ball seat, a pressure of the well fluid is increased.

An aspect combinable with any of the other aspects includes the following features. After the released plug closes the respective ICD, well fluid is continued to be flowed onto the dropped ball causing the dropped ball to dissolve.

An aspect combinable with any of the other aspects includes the following features. The multiple plugs are directly connected to each other.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

FIGS. 2A-2E are schematic diagrams showing a plug received within a compartment in which an ICD is installed.

Like reference numbers and designations in the various drawings indicate like elements.

DETAILED DESCRIPTION

A wellbore completion is an assembly of well tools used to control flow of hydrocarbons through a wellbore formed through a subterranean zone including multiple fluid producing zones. The fluid producing zones include production zones from which hydrocarbons (e.g., multiphase petroleum, natural gas) flow into a production tubing installed in the wellbore. The fluid producing zones can include water zones from which water flows into the production tubing. In some instances, after hydrocarbons in a production zone has flowed into the production tubing for a duration, water can flow from the same production zone into the production tubing.

A completion (or completion assembly) can include, for example, well tools such as packers, tubings and ICDs, to name a few. In an open hole, i.e., a wellbore without a casing, the packer can be set at a downhole location, and well tools can be installed uphole and downhole of the packer. Well tools installed uphole of the packer form an upper completion, while those installed downhole of the packer form a lower completion. The production tubing can extend uphole and downhole of the packer.

This disclosure describes a downhole completion assembly multiple ICDs of a downhole completion assembly to control the flow of fluids from fluid producing zones into the production tubing. As described below, the multiple ICDs are installed in respective compartments of successively smaller diameters into which plugs can be dropped and sealed to stop flow from the fluid producing zones. In this manner, flow of well fluids into the production tubing can be controlled. For example, when water begins to flow into the production tubing from a fluid producing zone, then the ICD that controls fluid flow from that zone into the production tubing can be closed using a plug of appropriate diameter. By implementing operations described here, well fluids can continue to be produced through the production tubing and from the other ICDs.

Figure 1:
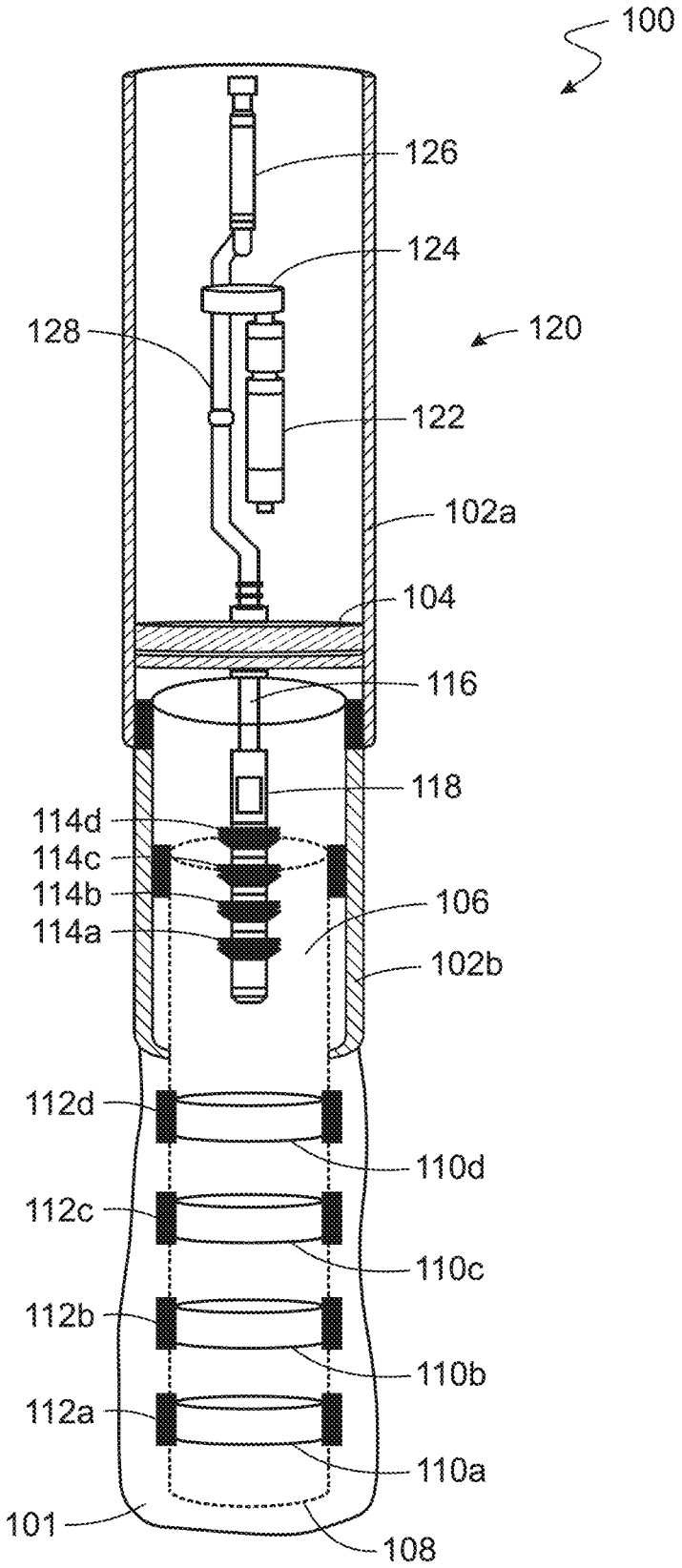
FIG. 1 is schematic diagram of a well completion with multiple plugs to close respective ICDs.

FIG. 1 is schematic diagram of a well completion 100 with multiple plugs to close respective ICDs. The well completion 100 is configured to be installed within a wellbore 101 formed through a subterranean zone (not shown) that includes multiple fluid producing zones. The wellbore can be cased with liners of successively smaller diameters, e.g., a liner 102*a* and a liner 102*b*. A packer 104 can be installed within one of the liners, e.g., the liner 102*a*. Well completion tools can be installed uphole and downhole of the packer 104.

The lower completion assembly 106 installed downhole of the packer 104 includes a tubing 108 that is hung from the liner 102*b*. Installed in the tubing 108 are multiple compartments (e.g., compartments 110*a*, 110*b*, 110*c*, 110*d*) serially connected to each other and arranged sequentially from an uphole location to a downhole location. The multiple compartments define successively smaller diameters from the uphole location to the downhole location. For example, an inner diameter of the compartments 110*a*, 110*b*, 110*c* and 110*d* is 3.625 inches (about 9.2 cm), 3.5 inches (about 8.9 cm), 3.375 inches (about 8.6 cm) and 3.25 inches (about 8.2 cm). By serially connected, it is meant that the multiple compartments are installed in the tubing 108 adjacent to each other. The compartments can be spaced apart, with the distance between compartments being equal to a distance between fluid producing zones in the subterranean zone. Under this arrangement, each compartment resides in (i.e., is at the same depth as) a respective fluid producing zone. Each compartment defines an opening through which fluids from the respective fluid producing zone in which each compartment resides can flow into the compartment and into the tubing 108. In this manner, fluids from different fluid producing zones enter the tubing 108 through the multiple compartments and flow towards the surface of the wellbore. To prevent commingling of fluids from different zones, packers can be installed outside the tubing 108 to seal off one fluid producing zone and the compartment installed in that zone from other fluid producing zones.

The lower completion 106 includes multiple ICDs (e.g., ICDs 112*a*, 112*b*, 112*c*, 112*d*). Each ICD is configured to be installed at a respective fluid producing zone. In particular, each ICD is configured to be installed in a respective compartment that resides in the respective fluid producing zone. As described earlier, each compartment defines an opening through which fluids from the respective fluid producing zone flow into the compartment. Each ICD can include a sliding sleeve that can slide to open or close the opening to control (e.g., permit, prevent or throttle) flow of the well fluid into the respective compartment. The sliding of the sleeve can be controlled by the well operator.

The lower completion 106 includes multiple plug (e.g., plugs 114*a*, 114*b*, 114*c*, 114*d*). Each plug is configured to be received in a respective compartment to close flow of well fluids from the subterranean zone, specifically, the fluid producing zone in which the respective compartment resides, into the wellbore 101, specifically, the tubing 108. The multiple plugs are serially connected to each other. That is, the multiple plugs are directly connected to each other to form a chain of plugs. The multiple plugs are installed uphole of the multiple compartments. For example, the multiple plugs can be installed between the packer 104 and the uphole-most compartment of the multiple compartments. As described in more detail below, each plug can be activated to be released from the chain of plugs and drop in a downhole direction towards the multiple compartments. Each plug is sized to be received by a respective compartment. That is, the downhole-most plug is sized to be received by the downhole-most compartment and pass through each compartment uphole of the downhole-most compartment. Similarly, each successive plug uphole of the downhole-most plug is sized to be received by a respective compartment uphole of the downhole-most compartment while passing through other uphole compartments. When received in a compartment, the plug is configured to close the opening in the compartment through which the well fluids from the fluid producing zones flow into the tubing 108. The plug is also configured such that, after closing the opening in the compartment, the plug can permit flow of fluids through the tubing 108, for example, from locations downhole of the plug to locations uphole of the plug.

In some implementations, a tubing 116 can be fluidically coupled to the multiple plugs. For example, a lower end of the tubing 116 can be coupled to the uphole-most plug, and the tubing 116 can pass through the packer 106 towards the surface. Fluids from the multiple fluid producing zones can flow from the tubing 108 into the tubing 116 and towards the surface. The lower completion 106 can include a sliding sleeve 118 uphole of the multiple plugs (e.g., between the packer 104 and the uphole-most plug). For example, the sliding sleeve 118 can be installed in the tubing 116. When open, the sliding sleeve 118 can permit hydrocarbons to flow from the tubing 108 into the tubing 116 through the open sliding sleeve 118. As described below, the sliding sleeve 118 can be closed to activate the plugs.

The completion 100 includes an upper completion 120 that is installed within the wellbore 101 uphole of the packer 104. The upper completion 120 includes an electrical submersible pump (ESP) 122 that is fluidically coupled to the tubing 116 to raise fluids flowed into the tubing 116 from the subterranean zone towards the surface. In some implementations, the upper completion 120 includes a gas separator 124 (e.g., a Y-tool) installed between the tubing 116 and the ESP 122 to reduce or remove gaseous phase from the multiphase fluids flowing through the ESP 122. The upper completion 120 also includes a subsurface safety valve (SSSV) 126 installed in the tubing 116 near the surface. The well operator can operate the SSSV 126 to control (i.e., permit, prevent or throttle) flow through the tubing 116 either in the uphole or in the downhole direction. The upper completion 120 also includes a portion of the tubing 116 (namely, the by-pass tubing 128) that is fluidically coupled in parallel to the ESP 122 and the gas separator 124.

The number of plugs in the completion assembly is equal to the number of ICDs, which, in turn, is equal to the number of compartments. The schematic diagram of FIG. 1 shows four plugs for four ICDs to be received in four compartments. Alternative implementations can include fewer (at least two) or more plugs, ICDs and compartments with successively decreasing inner diameters from the uphole location to the downhole location.

FIGS. 2A-2E are schematic diagrams showing a plug (e.g., the plug 114*a*) received within a compartment (e.g., the compartment 110*a*) in which an ICD (not shown) is installed. FIG. 2A schematically shows the plug 114*a* received within the compartment 110*a*. As described earlier, each compartment is sized to receive a corresponding plug. The downhole-most compartment has the smallest diameter to receive the smallest plug, while the uphole-most compartment has the largest diameter to receive the largest plug. Due to this arrangement, the plug meant to be received in the downhole-most compartment can pass through each uphole compartment. FIG. 2B shows profiles 202*a* and 202*b* formed on an inner wall of the compartment 110*a*. Each profile can be a slot that is cut in the inner wall of the compartment 110*a*. FIG. 2C shows extendable members 204*a* and 204*b* extending from an outer surface of the plug 114*a*. The number of extendable members can equal the number of profiles. Alternatively, the profile can be formed as a single groove extending radially on an inner circumferential wall of the compartment 110*a*. The extendable members can be sized to fit within the profile.

FIG. 2D shows a plug 114*a* being lowered into or falling into the compartment 110*a*. The plug 114*a* includes a spring (e.g., spring 206*a* or spring 206*b*) attached to an extendable member (e.g., extendable member 204*a* or extendable member 204*b*, respectively). When the plug 114*a* is lowered into the compartment 110*a*, the spring is in a biased (i.e., compressed) state and the extendable member is retracted, e.g., such that an outer edge of the extendable member is flush with or within an outer wall of the plug 114*a*. FIG. 2E shows the plug 114*a* seated within the compartment 110*a*. When the plug 114*a* reaches the profile (e.g., the profile 202*a* or the profile 202*b*), then the spring returns to an unbiased (i.e., relaxed) state pushing the extendable member outward and into the profile. In some implementations, the uphole end of the profile has a tapered edge and the downhole end of the profile has a comparatively horizontal edge. The uphole end of the extendable member is similarly tapered and the downhole end of the extendable member similarly has a comparatively horizontal edge. Such construction allows the extendable member to sit securely within the profile. The profile on the compartment is formed near the opening of the compartment to the fluid producing zone such that when the plug is received in the compartment and the extendable members are seated in the respective profiles, the plug closes the opening and prevents fluid flow into the compartment.

Figure 3A:
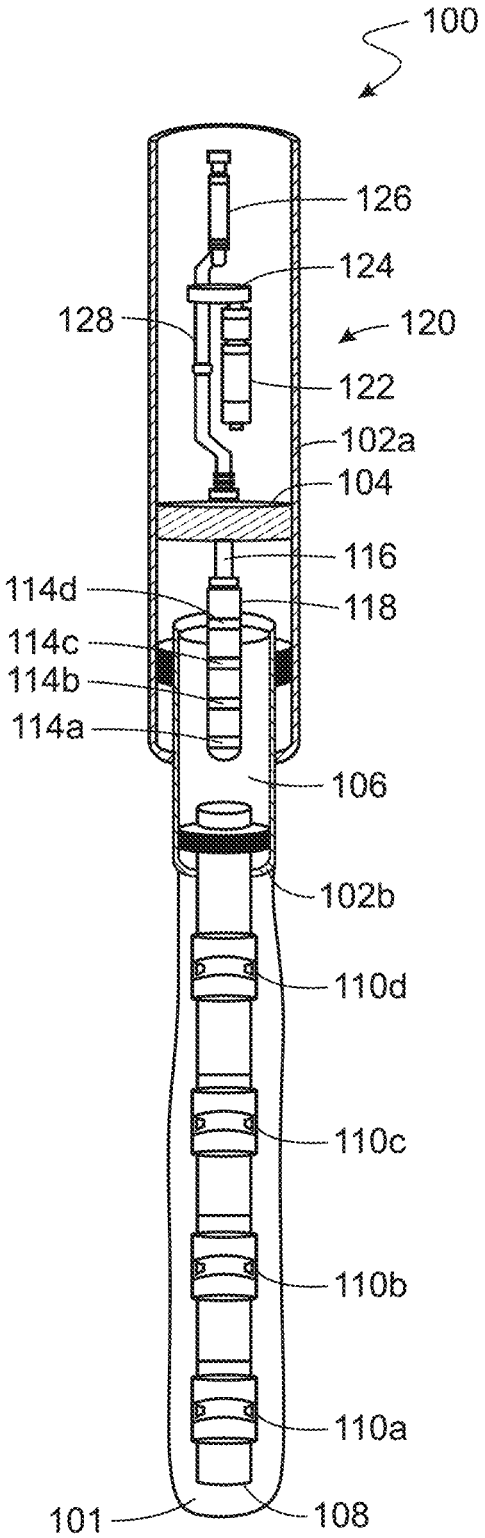
FIGS. 3A-3E are schematic diagrams showing control of ICDs using the multiple plugs.

FIGS. 3A-3E are schematic diagrams showing control of ICDs using the multiple plugs. FIG. 3A is a schematic diagram in which none of the plugs have been activated. All the ICDs installed in the respective compartments are open. Fluids are flowing into the compartments from the respective fluid producing zones in which the compartments are installed. The multiple plugs, serially connected to each other, are hanging uphole of the multiple compartments.

Figure 3B:
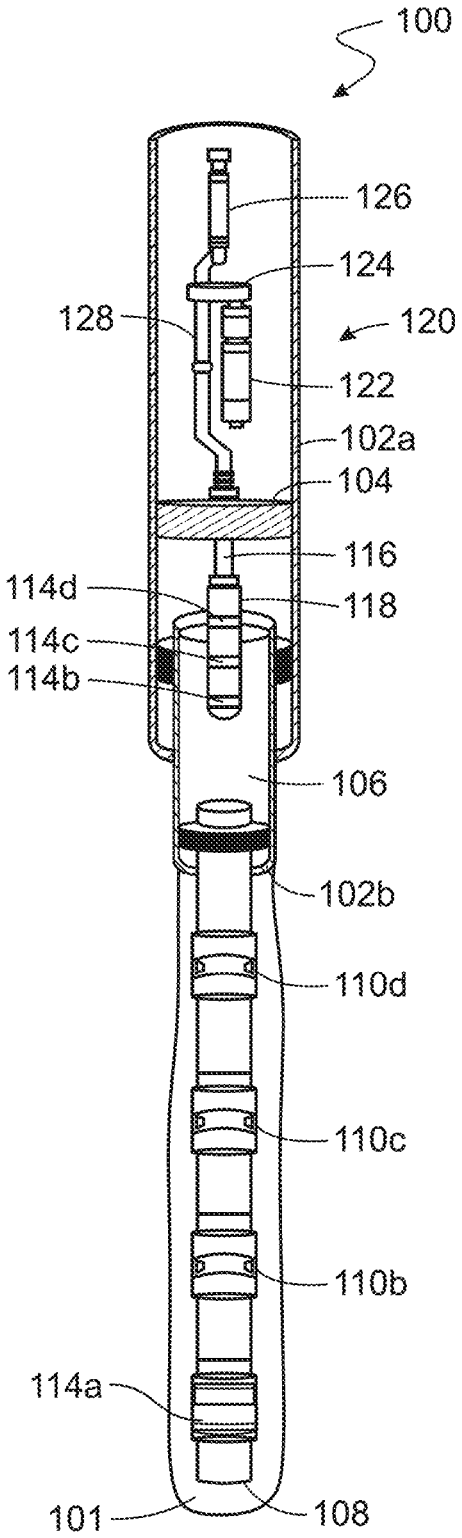

FIG. 3B is a schematic diagram in which the bottomhole-most compartment (e.g., the compartment 110*a*) is to be closed to fluid from the fluid producing zone in which the compartment 110*a* is installed. For example, water could have been detected from that fluid producing zone resulting in a determination to close flow from that zone. For example, production logging operations performed using a production logging tool run into the tubing 108 can reveal that water or gas (instead of petroleum) has begun to flow into the tubing 108 from the fluid producing zone.

To close flow from the zone, the bottomhole-most plug 114*a* is activated to separate from the remaining plugs and to fall downhole towards the compartment 110*a*. The multiple plugs can be connected to each other to form the chain of plugs using shear pins.

Each plug includes a respective ball seat (for example, 103*a* as shown in FIG. 2A). The sizes of the ball seats decrease from the uphole-most plug to the downhole-most plug. To activate the plug 114*a*, a ball (for example, 103*b* as shown in FIG. 2A) sized for the ball seat of the plug 114*a* is dropped from the surface, e.g., through the tubing 116. The falling plug 114*a* passes through the compartments uphole of the compartment 110*a*. Upon falling into the compartment 110*a*, the extendable members of the plug 114*a* extend radially outward and into the profile formed in the inner wall of the compartment 110*a* causing the plug 114*a* to securely sit within the compartment 110*a*. When so seated, the plug 114*a* closes the opening that permits fluid flow from the fluid producing zone into the compartment 110*a*.

Figure 3C:
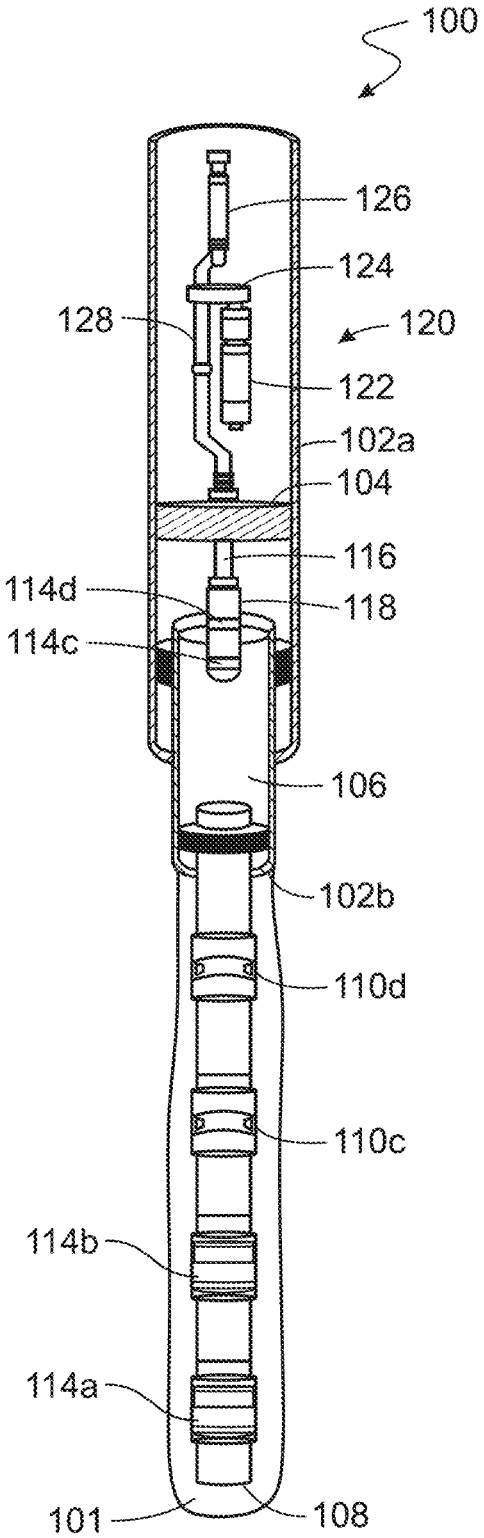

FIG. 3C is a schematic diagram in which the compartment 110*c* is to be closed to fluid from the fluid producing zone in which the compartment 110*c* is installed. In some implementations, the compartment 110*c* is to be closed after the compartment 110*a* has been closed as described above with reference to FIG. 3B. In such implementations, the processes described above with reference to FIG. 3B can be repeated, except that a ball used to activate the plug 114*b* is larger than the ball used to activate the plug 114*a*.

Figure 3D:
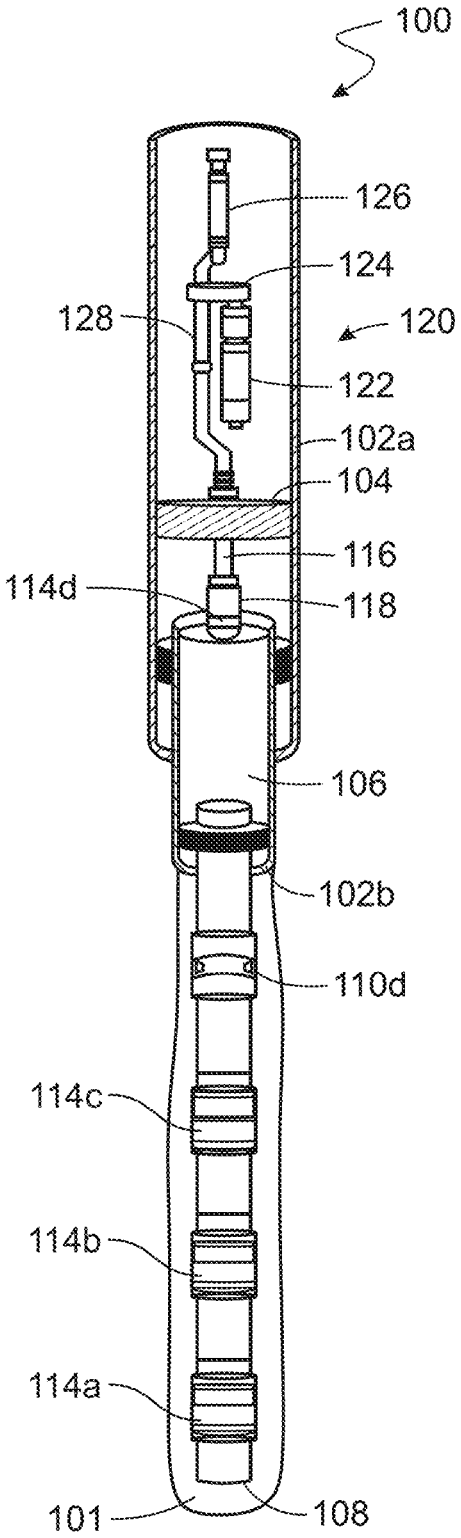
Figure 3E:
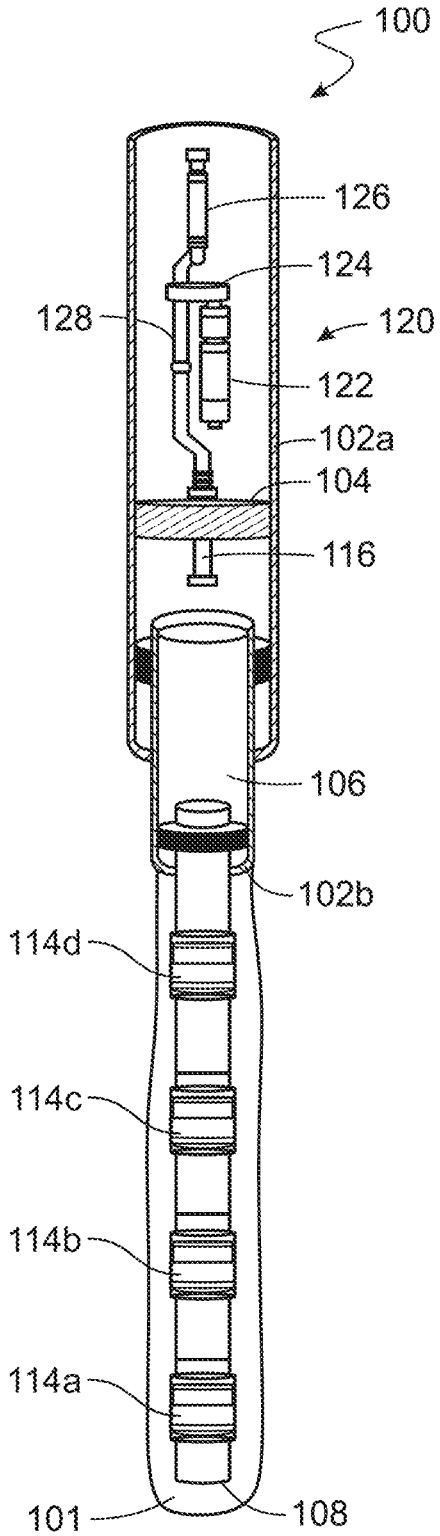

FIGS. 3C and 3D are schematic diagrams in which the compartments 110*b* and 110*c*, respectively, have been closed by activating the plugs 114*b* and 114*c*, respectively, using techniques similar to those described above with reference to FIGS. 3A and 3B. FIG. 3E is a schematic diagram in which compartment 110*d* has been closed by activating plug 114*d*, using techniques similar to those described above with reference to FIGS. 3A-3D.

In some implementations, a compartment uphole of the downhole-most compartment (e.g., the compartment 110*c*) may need to be closed without closing the downhole-most compartment 110*a*. In such implementations, the plug 114*c* is activated in a manner similar to that described above, i.e., by dropping a ball sized to be received in the ball seat of the plug 114*c* and increasing fluidic pressure uphole of the plug 114*c* to shear the plug 114*c* from the chain of plugs. In such implementations, plugs that are positioned downhole of the plug 114*c* (namely, the plugs 114*b* and 114*a*) also fall downhole with the plug 114*c*. The falling plugs pass through any compartment uphole of the plug 110*c*. The plugs 114*b* and 114*a* pass through the compartment 110*c*, but the plug 114*c* sits within the compartment 110*c*, as described earlier, thereby closing flow of fluids from the fluid producing zone in which the compartment 110*c* is installed.

In this configuration, the plugs 114*b* and 114*a* remain attached to the plug 114*c*. The presence of the ball in the ball seat of the plug 114*c* prevents flow of fluids from compartments downhole of the compartment 110*c*. To permit flow from the downhole compartments, a dissolvable ball is used to activate the plug 114*c*. After the plug 114*c* has been seated in the compartment 110*c*, fluid can be pumped onto the ball until the ball dissolves. Once the ball has dissolved, fluid from compartments downhole of the compartment 110*c* can flow through the ball seats of the plugs 114*c*, 114*b* and 114*a* towards the surface.

Later, if it is determined that a compartment downhole of the compartment 110*c* (e.g., the compartment 110*b*) needs to be closed, then a ball sized to fit in the ball seat of the plug 114*b* can be dropped and the completion pressurized. Doing so shears the pins holding the plug 114*b* and the plug 114*a*, and separates the two plugs from the plug 114*c*. The tandem plugs 114*b* and 114*a* fall downhole towards and close the compartment 110*b* in a manner similar to that described earlier. Also, by implementing techniques described earlier, fluid that flows into the compartment 110*a* can be flowed toward the surface through the plug 114*b*. In addition, by implementing techniques described earlier, the plug 114*a* can be separated from the plug 114*b* and dropped further downhole to close the compartment 110*a*.

Figure 4:
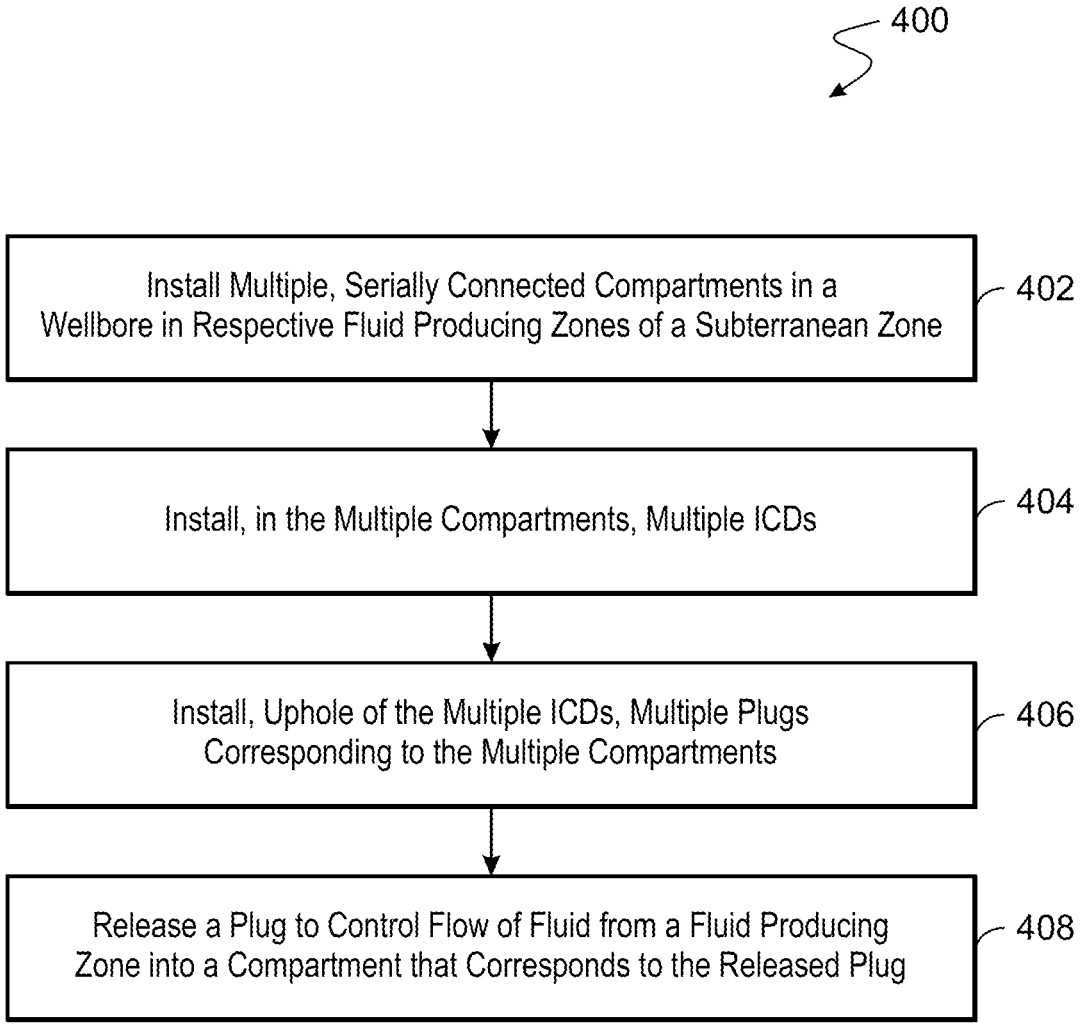
FIG. 4 is a flowchart of an example of a process of controlling ICDs using the multiple plugs.

FIG. 4 is a flowchart of an example of a process 400 of controlling ICDs using the multiple plugs. The process 400 can be performed by a well operator.

At 402, multiple serially connected compartments can be installed in a wellbore in respective fluid producing zones of a subterranean zone. At 404, multiple ICDs can be installed in the multiple compartments. For example, each ICD can be installed in each compartment, and a well completion can be made up using the compartments and ICDs. The well completion can then be run into the wellbore. At 406, multiple plugs corresponding to the multiple ICDs can be installed uphole of the multiple compartments. At 408, a plug can be released to control flow from a fluid producing zone into a compartment that corresponds to the released plug.

Thus, particular implementations of the subject matter have been described. Other implementations are within the scope of the following claims.

The invention claimed is:

1. A well completion assembly comprising:

a plurality of inflow control devices (ICDs), each ICD configured to be installed at a respective fluid producing zone of a subterranean zone and to control flow of well fluids from the respective fluid producing zone into a wellbore formed in the subterranean zone;

a plurality of compartments corresponding to the plurality of ICDs, each ICD configured to be installed within a respective compartment, the plurality of compartments serially connected to each other and arranged sequentially from an uphole location to a downhole location, the plurality of compartments defining successively smaller diameters from the uphole location to the downhole location; and a plurality of plugs corresponding to the plurality of compartments, each plug configured to be received in a respective compartment to close flow of well fluids from the subterranean zone into the wellbore through a respective ICD installed in the respective compartment, wherein the plurality of plugs is directly connected to each other and suspended uphole of the plurality of compartments.

2. The assembly of claim 1, wherein each compartment defines a profile formed as a slot in an inner wall of each compartment, wherein each plug comprises an extendable member configured to fit in the slot of the respective compartment in which each plug is configured to be received.

3. The assembly of claim 2, wherein, each plug comprises a spring connected to the extendable member, wherein, with the spring in a biased state, the extendable member is retracted within the plug, and wherein, in response to the extendable member being radially aligned with the profile, the spring returns to an unbiased state to radially push the extendable member into the slot.

4. The assembly of claim 1, wherein each plug defines a ball seat configured to receive a ball, wherein each plug, upon receiving the ball in the ball seat and in response to pressure, is configured to detach from remaining plugs and to travel in a downhole direction towards the plurality of compartments.

5. The assembly of claim 1, further comprising a wellbore tubing in which the plurality of compartments is mounted.

6. The assembly of claim 5, wherein the plurality of compartments is spaced apart along a length of the wellbore tubing.

7. The assembly of claim 1, further comprising a packer configured to be installed uphole of the plurality of plugs.

8. The assembly of claim 7, further comprising a tubing fluidically coupled to the plurality of plugs, passing through the packer, and extending to a surface of the wellbore, the tubing configured to flow well fluids produced through the plurality of ICDs towards the surface.

9. The assembly of claim 8, wherein the plurality of ICDs and the plurality of compartments form a downhole completion assembly, wherein the assembly comprises an uphole completion assembly configured to be installed within the wellbore uphole of the packer.

10. The assembly of claim 9, wherein the uphole completion assembly comprises:

an electrical submersible pump (ESP) fluidically coupled to the tubing, the ESP configured to raise the well fluids towards the surface;

a gas separator fluidically coupled to the ESP and the tubing, the gas separator configured to separate gaseous phase from the well fluids before the well fluids are flowed through the ESP; and a subsurface safety valve (SSSV) fluidically coupled to the tubing and installed uphole of the ESP and the gas separator.

11. A method comprising:

installing, in a wellbore formed through a subterranean zone comprising a plurality of fluid producing zones, a plurality of compartments serially connected to each other and arranged sequentially from an uphole location to a downhole location, each compartment installed in a respective fluid producing zone, the plurality of compartments defining successively smaller diameters from the uphole location to the downhole location;

installing, in the plurality of compartments, a respective plurality of inflow control devices (ICDs), each ICD configured to control flow of well fluids from the respective fluid producing zone into the wellbore;

installing, in the wellbore and uphole relative to the plurality of ICDs, a plurality of plugs corresponding to the plurality of compartments, each plug configured to be received in a respective compartment to close flow of well fluids from the subterranean zone into the wellbore through a respective ICD installed in the respective compartment wherein the plurality of plugs is directly connected to each other; and in response to identifying a fluid producing zone from which well fluid flow into the wellbore is to be ceased, releasing a corresponding plug of the plurality of plugs, wherein the released plug is received by the respective compartment and closes the respective ICD installed within the respective compartment.

12. The method of claim 11, wherein releasing the corresponding plug comprises:

dropping a ball configured to dissolve in a presence of a well fluid from a surface onto a ball seat included in the released plug; and after dropping the ball onto the ball seat, increasing a pressure of the well fluid.

13. The method of claim 12, further comprising, after the released plug closes the respective ICD, continuing to flow the well fluid onto the dropped ball causing the dropped ball to dissolve.

* * * * *